United States Patent [19]

Hoyt

[11] Patent Number: 4,664,301

[45] Date of Patent: May 12, 1987

[54] SPOUT AND SPOUT-HOLDING ACCESSORY FOR CONTAINERS

[75] Inventor: Earl E. Hoyt, Franklin Lakes, N.J.

[73] Assignee: Nationwide Industries, Inc., Trevose, Pa.

[21] Appl. No.: 721,648

[22] Filed: Apr. 10, 1985

[51] Int. Cl.[4] ..... B65D 25/48

[52] U.S. Cl. ..... 222/538; 222/475; 222/567; 220/855 P; 248/359

[58] Field of Search ..... 222/538, 475, 465 R, 222/566, 567, 570; 248/359 R, 359 E, 359 F, 359 G, 359 H; 220/85 SP, 85 R, 85 F

[56] References Cited

U.S. PATENT DOCUMENTS

| | | | |
|---|---|---|---|
| 1,411,573 | 4/1922 | McGarrahan | 222/538 |
| 2,673,665 | 3/1954 | Smith | 222/475 |
| 3,750,722 | 8/1973 | Nowak | 222/570 |
| 4,369,890 | 1/1983 | Bennett | 222/570 |

FOREIGN PATENT DOCUMENTS

| | | | |
|---|---|---|---|
| 0265660 | 10/1913 | Fed. Rep. of Germany | 222/567 |
| 0905900 | 4/1960 | United Kingdom | 220/855 P |

*Primary Examiner*—Joseph J. Rolla
*Assistant Examiner*—Frederick R. Handren
*Attorney, Agent, or Firm*—Louis Weinstein

[57] ABSTRACT

This accessory is for releasable attachment to the top rim or bead of a container such as a metal or plastic can or similar container made out of combinations of materials. It comprises an attachment portion which supports two upstanding bracket members between which a spout is disposed. One end of the spout is arranged in an aperture in one of the bracket members and has a ridge formed thereon for enabling it to be snapped into the opening of the container when the cap or lid is removed. The end of the spout is releasably held in an aperture in the other bracket member until it is desired to use the accessory. Then, the other end of the spout is disengaged from its associated bracket member, and the first-mentioned end thereof is snapped into the container opening from which the cap or lid has been removed. Since, in one embodiment, the accessory is made of flexible plastic material, the parts of the accessory other than the spout may be arranged out-of-the-way to permit insertion of the first end of the spout into the opening of the container.

19 Claims, 5 Drawing Figures

SPOUT AND SPOUT-HOLDING ACCESSORY FOR CONTAINERS

BACKGROUND OF THE INVENTION

A. Field of the Invention

This invention relates to containers for liquids intended to be directed to a particular point of application and, in particular, to an accessory for such containers for releasably mounting a spout to said container.

B. Prior Art

There are many instances in which liquids are intended to be dispensed from containers to predetermined points of application. For example, many liquids are intended to be poured into particular openings from the container. One example of this is a container containing a gasoline additive which is to be applied to the gasoline tank through the gasoline filling pipe opening. In doing so, it is important that the liquid not go elsewhere than in the pipe lest it mar the car's finish.

While a spout could be fastened to the opening on a can by simply mounting the spout having a threaded end onto a correspondingly threaded protruding opening of the can, if the can is knocked over, or if the free end of the spout is not tightly covered, the liquid contents may spill out or may evaporate. Besides, the length of the spout may make the overall package too high for shelving systems of stores or garages where it may be placed for convenience. Convenience for the consumer is greatly to be desired to save the consumer time and to keep the distributor of a liquid product competitive. It is also desired to keep the liquid contents of the container within that container when not in use both to prevent its accidental spilling or evaporation, or to enable child-proof closures to be used when the container contents are not to be dispensed.

The prior art contains numerous examples of accessories or attachments for containers which include liquid-directing elements such as spouts. Among them are U.S. Pat. Nos. 3,160,327; 3,204,829; 3,750,722; 4,129,236 and 4,403,709. U.S. Pat. No. 3,160,327 teaches a plastic spout and retroflexing closure therefor which is formed integrally into the opening of the container. It has no provision for a releasable attachment of an elongated spout, nor does it have a screw-on-gasketed type of cap for the opening.

U.S. Pat. No. 3,204,829 also does not provide an elongated spout nor does it enable the use, when desired, of a screw-on-gasketed type of cap or other child-proof closure.

U.S. Pat. No. 3,750,722 shows a container for a liquid such as oil in which the wide end of a funnel snaps over the rim of the can and the small end of a funnel, which may be capped, extends upwardly. This increases the height of the container unnecessarily and does not enable the very tight closure that is required for volatile or dangerous liquids that may be within the container after it is once opened.

U.S. Pat. No. 4,129,236 is a spout which is primarily intended to be integral with the container. It also extends upwardly from the container for a distance which may be undesirable for marketing purposes. Furthermore, it does not permit the use of a screw-on-gasket closure for prevention of evaporation and child security.

U.S. Pat. No. 4,403,709 is a pouring aid which snaps onto the upper rim of a can and has a spout formed therein. However, this spout is vertical and may extend upwardly for an undesirable distance. Besides, there is no way of using a very tight screw-on-gasket closure when the spout is not being used thereby preventing evaporation and possible misuse by children.

It is therefore among the objects of the present invention to provide an accessory for directing liquid from a container which:

1. Does not, when marketed, require excess vertical space.
2. Allows the use of a screw-on-gasket cap to close the opening of the container when the liquid-directing spout portion of the accessory is not being used.
3. Enables the container to use more childsecure closure means when the spout accessory is not being used.
4. Allows the associated container to be more tightly closed when the spout accessory is not being used thereby reducing loss of contents by evaporation.
5. Enables a liquid-directing spout or the like to be kept in accessible proximity to the container.
6. Has other advantages which will occur to the reader on perusal of the specification, claims and drawings herein.

BRIEF SUMMARY OF THE INVENTION

An accessory for a container of liquid having an opening therein comprising a liquid-directing member which has one end that may be releasably attached to the opening supported by bracket means for releasably attaching the accessory to the top of a container.

DETAILED DESCRIPTION OF THE DRAWINGS

Figure 1:
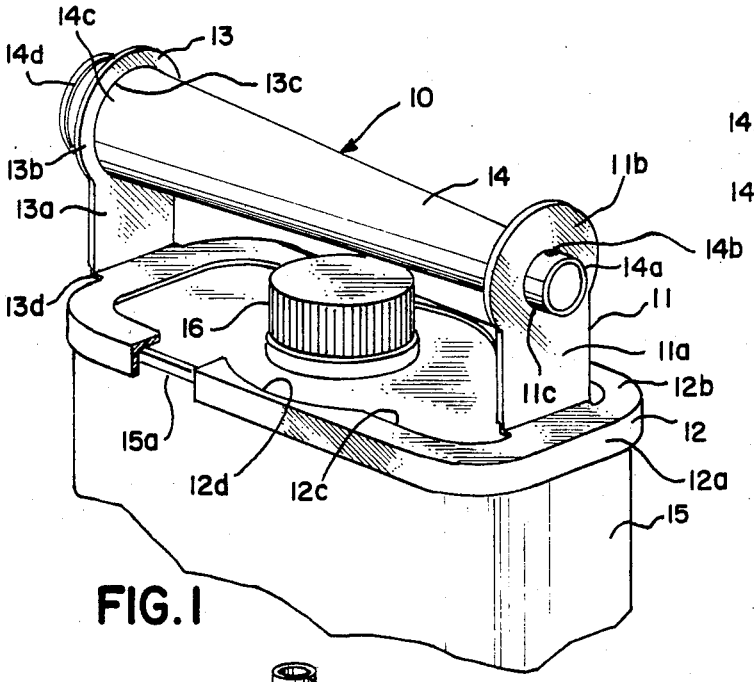
FIG. 1 is a fragmentary perspective view of the accessory shown in place on a closed container.

As shown in FIGS. 1–4, the accessory shown generally at the numeral 10 comprises an attachment portion 12 which is mounted on the bead or upper rim portion 15*a* of the container 15 which may be a metal can, for example. The accessory 10 may be made of, for example, synthetic plastic although other materials may also be found suitable. Extending transversely to the attachment sections 12, are bracket members 13 and 11, respectively between which a generally conical liquid-directing spout member 14 extends. The larger end portion 14*c* of the spout protrudes through the opening 13*c* in the bracket member 13. In one embodiment, as shown in FIGS. 1–4, the portion 14*c* is fixed into the opening 13*c* by heat-sealing or any other appropriate means. There is a circular ridge 14*d* formed in the outer end of 14*c* on the left (as seen in FIG. 1) side of member 13. The can 15 also is equipped with a cap 16 which may be of any conventional type such as screw-on-gasket closure that is used when the can 15 is not in use. The use of this cap enable the contents to be kept within the container so as not to be spilled accidentally or improperly used by children or to prevent evaporation of its contents.

Figure 2:
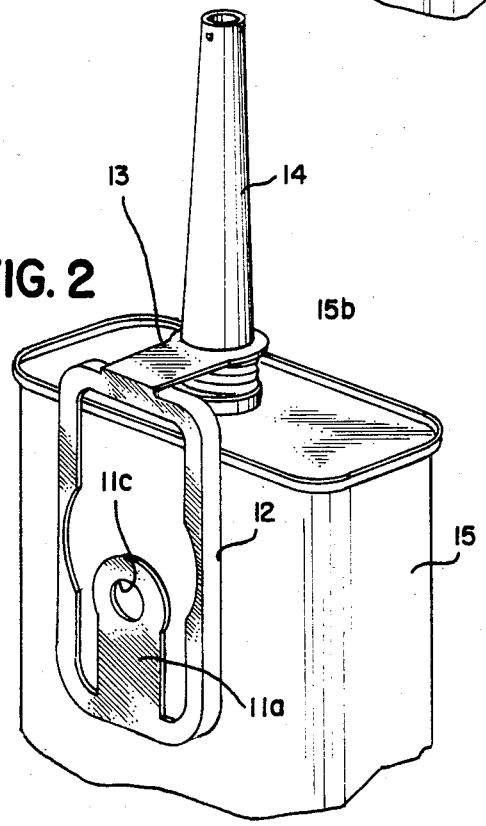
FIG. 2 is a fragmentary perspective view of the accessory shown in FIG. 1 in which the spout portion thereof is inserted into the opening of the container.
Figure 3:
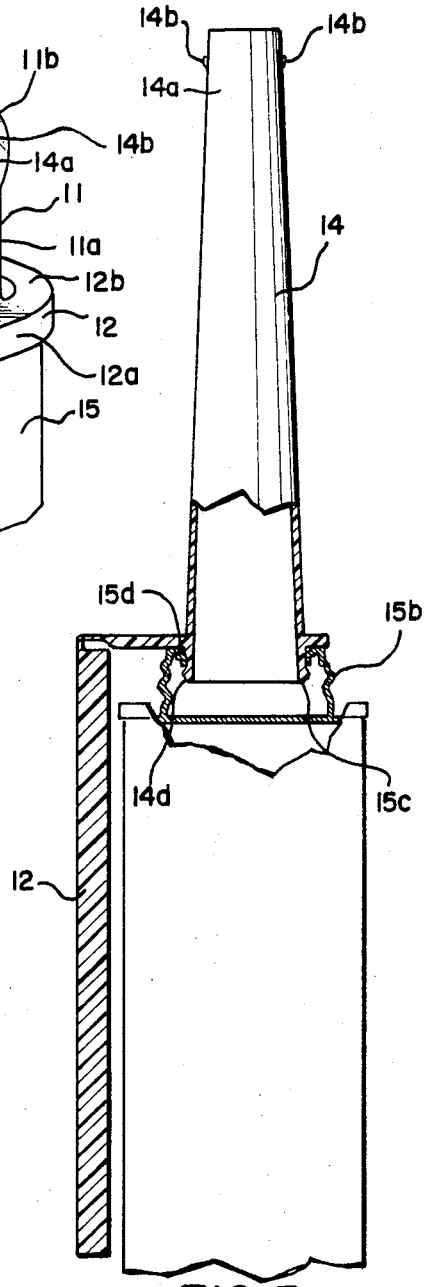
FIG. 3 is a fragmentary, partially sectional view of the apparatus shown in FIG. 2.
Figure 4:
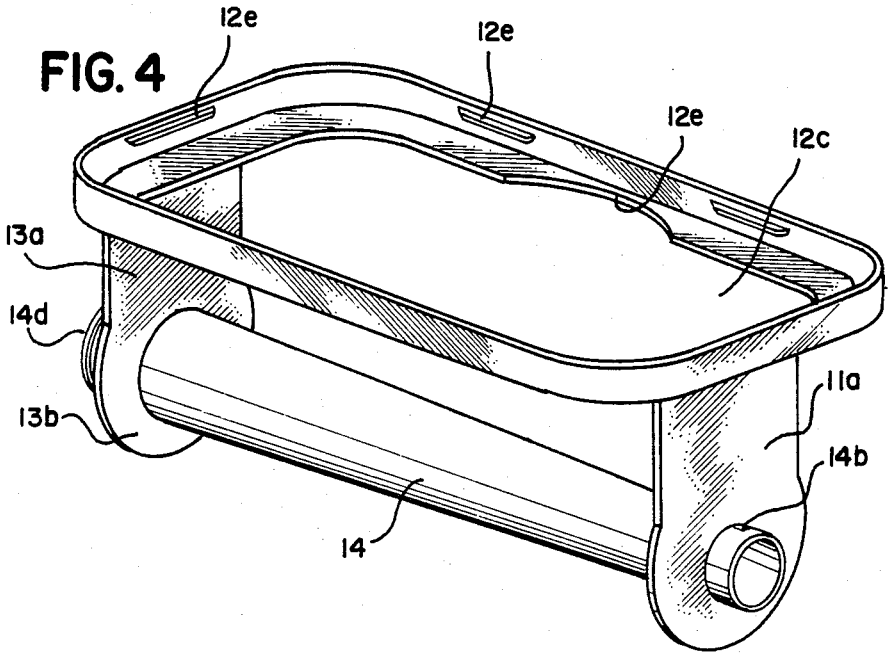
FIG. 4 is a perspective view showing the accessory upside down and apart from the container.

When the contents, however, are to be dispensed, the cap 16 is unscrewed and the accessory 10 is removed from the upper edge of the can by simply pulling it off. Then, the smaller end 14*a* of the spout 14 is disengaged from the aperture 11*c* in the portion 11*b* of the right bracket 11. This is simply accomplished by pulling those two parts away from one another over the retaining bosses 14*b* formed in the exterior surface of portion 14*a*. That done, the opposite end 14*c* of the spout 14 is snapped or inserted into the open end of the can so that the circular ridge 14*d*, as shown in FIG. 3, goes down below the inner edge portion 15*d* of the metal spout 15*b*. The ridge 14*d* moves outwardly once it passes the portion 15*d* thereby causing the auxiliary spout 14 to be retained by the metal spout 15*b*. The balance of the accessory 10, namely, the attachment means 12 and the bracket member 11 may be generally disposed along the side of the container as shown in FIG. 2. Since the member 11 as well as the rest of the accessory 10 are made of plastic, the member 11 may fold toward the plane of the attachment member 12 and bear against the flat side of the container 15.

To facilitate the movement of the bracket members 11 and 13 to positions substantially transverse to their positions as shown in FIG. 1, the junctions or hinges 11*d* and 13*d* respectively may be formed by making them of considerably lesser thickness than the portion 12*b* of the attachment means.

The accessory 10 in initially held on to the upper rim 15*a* of the can 15 by means of a plurality of ridges 12*e* formed in the interior surface of the portion 12*a* of the attachment means. When the accessory as shown in FIG. 1 is pressed down over the bead or rim 15*a*, the ridges 12*e* snap over the rim and into place below it thereby retaining the structure 10 in place until manual force is used to dislodge it when it is desired to remove it from the can. Once the auxiliary spout 14 has been used after insertion into the opening 15*c* of the can, the accessory may be pulled off of the top, the closure 16, with its internal gasket may be screwed over the metal spout 15*b* tightly and then the attachment portion 12 may again be arranged as shown in FIG. 1. The bracket member 13 may again be bent 90° and the free end 14*a* may be slipped through the bracket member 11 which has been moved parallel to bracket 13. The free end 14*a* is pushed through the opening 11*c* until the bosses 14*b* are able to retain that end in place.

Figure 5:
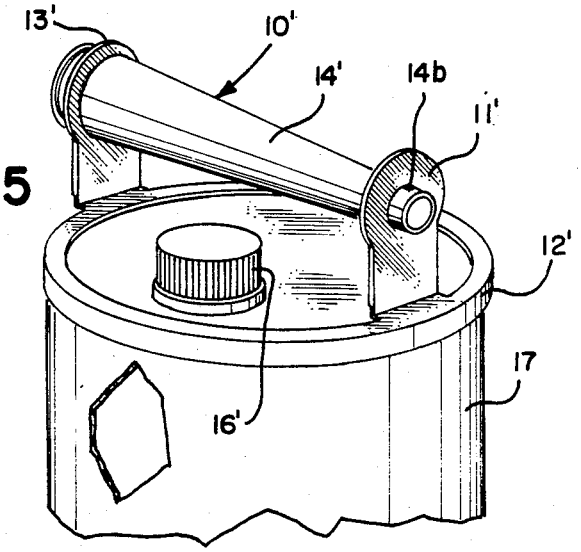
FIG. 5 is a fragmentary perspective view, partly sectional, of another form of the invention.

While the invention has been explained terms of a substantially rectangular-sectioned metal container, it is equally adaptable for use with a round, non-metallic container such as depicted in FIG. 5. The construction of the portion 12' may generally correspond to that of the portion 12 of the first embodiment except that the inner retaining ridges corresponding to ridges 12*e* (FIG. 4) may be slightly curved to conform to the configuration of the rim of the container 17. In FIG. 5, the closure 16' may be located off-center of the top of the can 17 if desired, although that is purely a matter of choice.

So far, the invention has been described in terms of a spout as the liquid-directing member. However, it is conceivable that the accessory may be adapted not to pour liquid directly onto a desired point, but rather to apply liquid to an intermediate applicator, such as a brush or cloth pad fitted to the end 14*a* of the tubular member 14. This intermediate applicator may slip over the end 14*a* and be retained by the boss 14*b* or other bosses located on the outer surface.

What is claimed is:

1. An accessory for a container having a top surface bounded by a rim and a dispensing opening formed in said top surface at a location spaced inwardly of said rim, said accessory comprising:

(a) attachment means for releasable attachment to said container rim, (b) first and second bracket means joined to said attachment means, and (c) liquid-directing means joined to said first bracket means and having one end thereof constructed to releasably engage said opening, the other end of said liquid-directing means being constructed to be releasably connected and disconnected from said second bracket means.

2. An accessory according to claim 1 wherein said attachment means is constructed to releasably engage said rim of said container.

3. An accessory according to claim 1 wherein each of said bracket means is flexibly joined to said attachment means.

4. An accessory according to claim 1 wherein said bracket means are aligned so that an imaginary plane passing through said bracket means is substantially symmetrically located about an axis passing through the center of one end of said container.

5. An accessory according to claim 4 wherein the cross-section of said container is substantially rectangular and said attachment means is also a continuous closed-loop generally rectangular member.

6. An accessory according to claim 1 wherein said attachment means has an opening formed therein through which a cap of said container may pass when said accessory is attached to said container.

7. An accessory according to claim 3 wherein said one end of said liquid-directing means is constructed and adapted to snap into or out of said dispensing opening of said container.

8. An accessory according to claim 1 wherein said liquid-directing means is a hollow substantially conical-shaped member.

9. An accessory according to claim 1 wherein the material thereof is substantially plastic.

10. An accessory according to claim 1 wherein said first and second bracket means comprise two members that may be moved to positions substantially transverse to said attachment means, each of said members having an opening and further wherein said liquid-directing means has said one end fixed into the opening of one of said members and said other end releasably engaged in the opening in the other of said members.

11. An accessory according to claim 10 wherein junction means for joining said first and second bracket means to said attachment means are flexible.

12. An accessory according to claim 11 wherein said flexible junction means are integral with said attachment means, but have thinner cross-sections than said attachment means.

13. An accessory according to claim 10 with the addition of means on the other end of said liquid-directing means to enable releasable attachment of said other end to said associated transverse member.

14. An accessory according to claim 9 wherein said attachment means includes means to snap it into releasable engagement with said rim.

15. An accessory according to claim 14 wherein said attachment means comprises a predetermined number of inwardly protruding ridges formed thereon.

16. An accessory according to claim 13 wherein said means for enabling releasable attachment comprises at least one boss formed on the outer surface of said other end of said liquid-directing means.

17. An accessory according to claim 4 wherein the cross-section of said container is substantially circular and further wherein said attachment means is also generally circular.

18. An accessory according to claim 7 wherein the terminal portion of said one end of said liquid-directing means has a protrusion formed in the outer surface thereof for releasably engaging an inner portion of said container dispensing opening.

19. An accessory according to claim 10 wherein when said one end of said liquid-directing means is inserted in said container opening, said other member may be folded to lie substantially in the plane of said attachment means.

* * * * *